United States Patent [19]

Maines

[11] 3,952,564

[45] Apr. 27, 1976

[54] PROTECTIVE DEVICE FOR DOOR KNOBS AND THE LIKE

[76] Inventor: Peter Maines, 1350-20th St. A-24, Boulder, Colo. 80302

[22] Filed: May 28, 1975

[21] Appl. No.: 581,693

[52] U.S. Cl. ..... 70/416; 70/424

[51] Int. Cl.[2] ..... E05B 13/00

[58] Field of Search ..... 70/209, 210, 211, 212, 70/416, 423, 424, 428, 447, DIG. 58, DIG. 56

[56] References Cited

UNITED STATES PATENTS

| | | | |
|---|---|---|---|
| 1,590,981 | 6/1926 | Lockyer | 70/424 X |
| 2,461,676 | 2/1949 | Budak | 70/416 |
| 3,210,972 | 10/1965 | Johnson | 70/211 |
| 3,340,709 | 9/1967 | Callahan | 70/209 |
| 3,623,346 | 11/1971 | Curtin | 70/424 |
| 3,739,608 | 6/1973 | Young | 70/209 |

FOREIGN PATENTS OR APPLICATIONS

| | | | |
|---|---|---|---|
| 619,653 | 3/1949 | United Kingdom | 70/416 |

*Primary Examiner*—Robert L. Wolfe
*Attorney, Agent, or Firm*—W. Britton Moore

[57] ABSTRACT

A protective device for mounting on and encasing a lock operating member, such as, a door knob to preclude access thereto and operation thereof. The casing includes a generally rectangular front opening through which the knob projects and a slide member vertically slidable therein which is adaptable to receive a locking means for securing the casing in position to prevent the locking mechanism of the knob from being actuated or removal of the knob.

3 Claims, 3 Drawing Figures

PROTECTIVE DEVICE FOR DOOR KNOBS AND THE LIKE

This invention relates to a protective device for mounting on and encasing a lock operating member, and having slide means arranged therein to readily lock and preclude the removal of the device therefrom.

A further object is to provide a generally rectangular casing with a front opening for accommodating a lock operating member and having a generally L-shaped slotted slide plate slidably arranged in the opening for securing the casing in position so that access to and operation of the member is precluded.

Still another object is the provision of a simple and inexpensive protective device which is readily mountable on and removable from a lock operating member and which precludes access to and operation thereof.

While various prior art protective devices have been proposed, such as, U.S. Pat. Nos. to Sherman 2,169,438, Marple 2,265,438, and Simmons 2,575,401, these devices are specifically designed for use with particular locking means and are rather complex and expensive to produce. It is, therefore, an objective of the present protective device to produce a very simple casing having a lockable slide plate arranged in a slotted opening therein which simplifies assembly on and removal from a lock operating member.

These and other objects and advantages will be apparent as the specification is considered in connection with the accompanying drawings, wherein FIG. 1 is a perspective view of the assembled casing, locking slide and padlock in locked position with reference to a lock operating knob;

Figure 1:
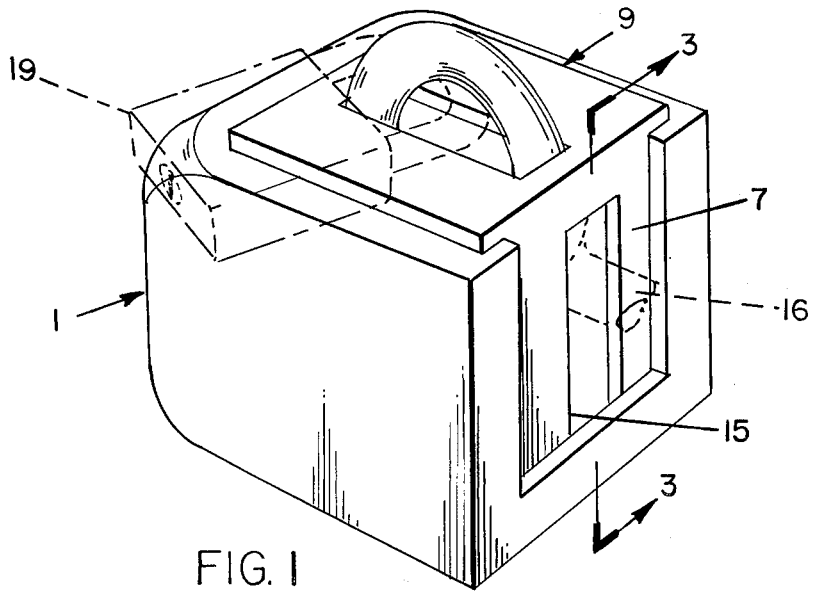
Figure 2:
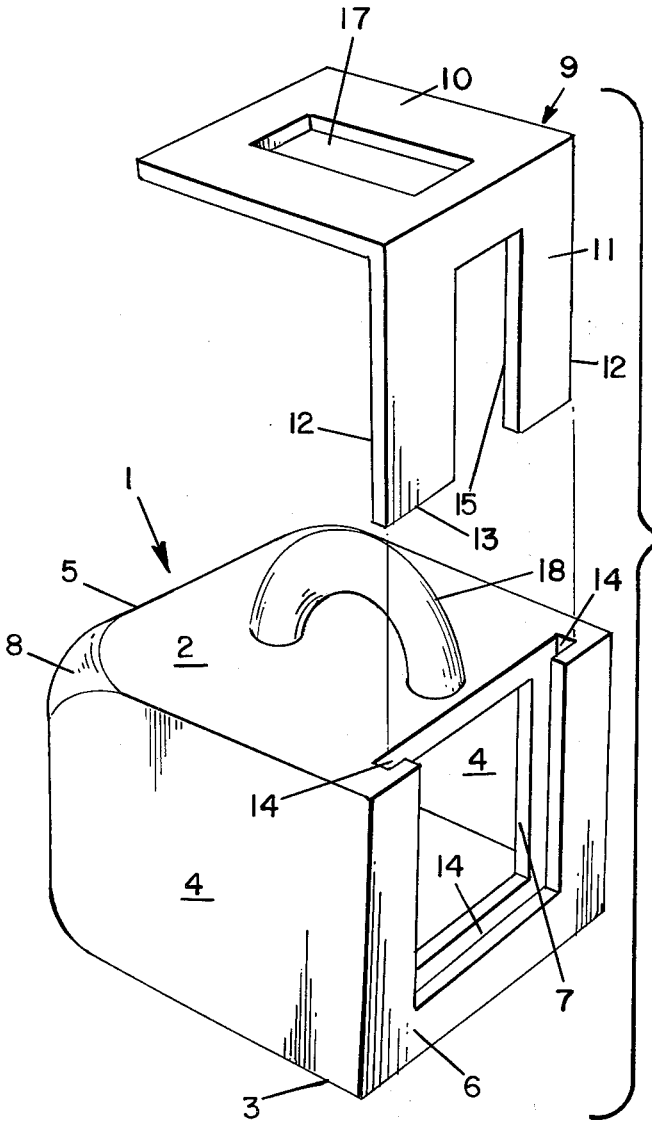
FIG. 2 is an exploded view of the disassembled casing and locking slide.
Figure 3:
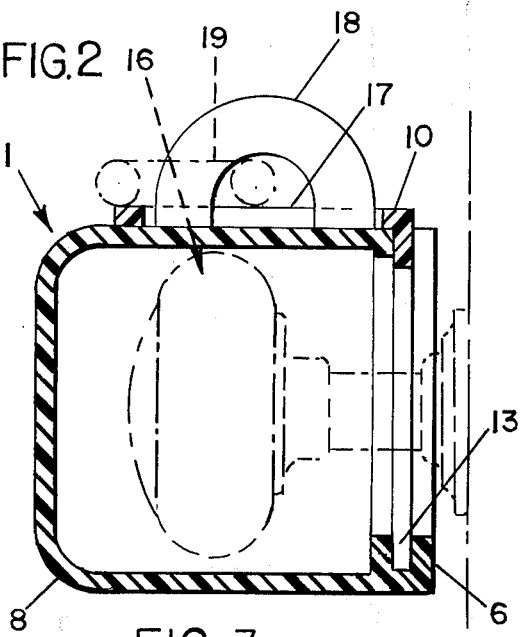
FIG. 3 is a vertical section along the line 3—3 of FIG. 1.

Referring more specifically to the drawings, wherein similar reference characters designate like parts throughout the several views, a generally rectangular casing 1, including flat top 2, bottom 3, sides 4, and rear and front walls 5 and 6, is provided with a generally rectangular opening 7 in the front wall 6 thereof. The casing may be formed of any suitable material, such as molded plastic or metal and the like, so as to present an integral, strong and compact unit, and the four rear corners are rounded, as at 8, to prevent bodily injury, when casing 1 is placed on a fixed object, such as, a door knob.

Opening 7 is adapted to be closed by a downwardly depending plate 11 of a right angularly disposed closure member 9 including a horizontally extending top plate 10. The side and bottom edges 12 and 13 of plate 11 slidably interfit in a track or inset 14 formed along the sides and across the bottom of opening 7 when the bottom edge 13 thereof is positioned within the upper ends of the track and the plate is moved downwardly in an obvious manner, to the closed FIG. 1 position. An elongated centrally arranged slot 15 is formed in plate 11 and extends from a point spaced below the upper end and opens into the bottom edge 13 thereof. The slot 15 is of a width sufficient to straddle any suitable closure or locking member, such as a door knob 16, having the usual key receiving opening, not shown, when the latter is caused to project through opening 7 in casing 1 and the slotted plate 11 is moved downwardly in track 14 and relative to the knob. It will, of course, be understood that this device may be used with other types of closure or locking members, such as padlocks and the like, not shown.

Formed generally in the center of the horizontal top plate 10 is a slot 17 which functions to accommodate an upstanding apertured ear or loop member 18, suitably anchored to the top 2 of casing 1 and projecting upwardly therefrom. Thus, when the casing 1 is positioned over and houses a door knob, for example, and plate 11 of closure member 9 is slid downwardly in opening 7 thereof so as to straddle the knob, it will be apparent that the horizontal top plate 10 will flatly engage top 2 of the casing, with ear 18 projecting upwardly through slot 17. Thus, a suitable locking member, such as, a padlock 19 may be arranged on the ear 18 to secure the closure member 9 in locked position on casing 1 and thereby preclude the door knob being grasped and will result in the casing 1 being freely rotated relative to the door knob and preclude the latter from being rotated for opening purposes.

It will be understood that the casing 1 will only be arranged on a door knob or the like when it is desired to prevent unauthorized use thereof, and that the casing and closure member may otherwise be stored or kept available for ready use.

While I have shown and described a preferred embodiment of my protective device, it is to be understood that various changes and improvements may be made therein without departing from the scope and spirit of the appended claims.

What I claim is:

1. A protective device for mounting on a lock operating member and the like comprising a generally rectangular casing including flat walls, a generally rectangular opening in the front wall thereof, a guide track being formed in the sides and bottom of said opening, a right-angularly disposed closure member having a downwardly depending slotted front plate and a horizontally disposed top plate, said slotted plate being slidably disposed in said guide track to straddle said lock operating member when positioned within said casing, said top plate being slotted, and an apertured ear on the top wall of said casing adapted to project through the slot in said top plate whereby a locking member is positionable therethrough to lock and retain said casing on said lock operating member and prevent access thereto and normal actuation thereof.

2. A protective device as claimed in claim 1, wherein said guide track is inset in the sides and bottom of said casing front opening, and the side and bottom edges of the slotted front plate interfit and are vertically slidable therein.

3. A protective device as claimed in claim 1, wherein the downwardly depending slotted front and horizontally disposed top plates are flat so as to snugly engage said lock operating member.

* * * * *